US008076992B2

(12) United States Patent
Rabi et al.

(10) Patent No.: US 8,076,992 B2
(45) Date of Patent: Dec. 13, 2011

(54) RADIO FREQUENCY MICROWAVE WAVEGUIDE STRUCTURE AND METHOD FOR FABRICATION THEREOF

(75) Inventors: Arie Rabi, Nes Ziona (IL); Yehuda Green, Yavne (IL)

(73) Assignee: Elta Systems Ltd., Ashdod (IL)

( * ) Notice: Subject to any disclaimer, the term of this patent is extended or adjusted under 35 U.S.C. 154(b) by 0 days.

(21) Appl. No.: 12/876,134

(22) Filed: Sep. 4, 2010

(65) Prior Publication Data

US 2011/0090029 A1 Apr. 21, 2011

Related U.S. Application Data

(63) Continuation of application No. PCT/IL2009/000222, filed on Feb. 26, 2009.

(30) Foreign Application Priority Data

Mar. 4, 2008 (IL) ..... 189940

(51) Int. Cl.
*H01P 1/26* (2006.01)

(52) U.S. Cl. ..... 333/22 R; 333/81 B

(58) Field of Classification Search ..... 333/22 R, 333/81 B, 248, 249, 251
See application file for complete search history.

(56) References Cited

U.S. PATENT DOCUMENTS 3,001,152 A 9/1961 Winkler
2001/0015509 A1 8/2001 Tiegs et al.

FOREIGN PATENT DOCUMENTS

FR 1232112 A 10/1960
FR 1232663 A 10/1960

OTHER PUBLICATIONS

International Search Report, mailed Jul. 22, 2009 from PCT/IL2009/000222, filed Feb. 26, 2009.
International Preliminary Report of Patentability, mailed Sep. 7, 2010 from PCT/IL2009/000222, filed Feb. 26, 2009.

*Primary Examiner* — Stephen Jones
(74) *Attorney, Agent, or Firm* — Houston Eliseeva, LLP

(57) ABSTRACT

A method for fabrication of an inaccessible RF microwave waveguide structure is provided. The method includes providing an RF microwave waveguide network including an array of waveguide components that have one or more apertures in a wall. The method also includes providing one or more dummy load elements made of a ceramic material having high-temperature stable properties. The dummy load elements are mounted in a predetermined place on the wall in the vicinity of the aperture. The method also includes providing a blocking assembly configured for covering RF microwave waveguide network. The blocking assembly is connected to the RF microwave waveguide network by using dip brazing.

11 Claims, 5 Drawing Sheets

RADIO FREQUENCY MICROWAVE WAVEGUIDE STRUCTURE AND METHOD FOR FABRICATION THEREOF

CROSS-REFERENCE TO RELATED APPLICATIONS

This application is a continuation application of International Application PCT/IL2009/000222 filed on Feb. 26, 2009, which in turn claims priority to Israeli application IL 189940 filed on Mar. 4, 2008, both of which are incorporated herein in their entirety.

FIELD OF THE INVENTION

This invention relates to a radio frequency (RF) microwave waveguide structure and a fabricating method thereof, and in particular to an inaccessible RF microwave waveguide structure.

BACKGROUND OF THE INVENTION

Radio frequency (RF) microwave waveguide networks are attractive for numerous applications, where high radiation efficiency is required. The fabrication of the RF microwave waveguide networks is a multi-step process. When such networks include multi-component assemblies, separate fabrication of individual components is usually employed. These components can then be joined using one of numerous techniques, such as brazing, soldering or welding. In particular, dip brazing is considered as the most technically easy and relatively cheap method for fabricating RF microwave waveguide networks. This method employs a submerging of the components to be joined into a molten bath of salt or flux, followed by quenching them slowly in hot water to dissolve the salt or flux. Specifically, the fixtured assembly is preheated in an air furnace to insure uniform temperature of dissimilar masses in the assembly, and then immersed in a bath of molten salt that contains flux (also known as filler metal). The molten flux serves a multi-purpose role: providing heat transfer, supporting the assembly, and fluxing the joints through a capillary action. The immersion time required for dip brazing may vary, but usually it is less than two minutes. The assembly is then removed from the bath, cooled, and cleaned to be ready for further processing.

FIG. 1 schematically illustrates an example of a typical RF microwave waveguide network 10 that can be fabricated by dip brazing. The RF microwave waveguide network 10 includes a complex array of waveguide components 11 coupled together at joint nodes 12 for effective transferring RF microwave signals. To absorb undesired RF microwave energy, ferrite termination parts, such as dummy loads 13, are used in the network 10.

FIG. 2 illustrates a portion of the RF microwave waveguide network shown in FIG. 1 in a magnified form for a clarification purpose. As shown, the dummy load 13 is attached to a surface in a wall 111 of the waveguide 11, and is adjacent to an aperture to 14 in the wall of the waveguide 11.

GENERAL DESCRIPTION

The conventional fabricating methods of the RF microwave waveguide networks cannot be used when such network is to be a part of inaccessible RF microwave waveguide structure. This is because the dip brazing technique conventionally used for connecting the multiple elements of the network requires that ferrite dummy loads are mounted after the dip brazing procedure. This is due to the fact that ferrite dummy loads cannot withstand high temperature treatment associated with the dip brazing process. Therefore, the dip brazing technique is not suitable for fabrication of inaccessible RF microwave waveguide structures, since dummy loads should be mounted within the structures before applying dip brazing.

For the purpose of the present application, the term "inaccessible RF microwave waveguide structure" refers to a structure comprising an RF microwave waveguide network in which those places where dummy loads are to be mounted are blocked or concealed inside the structure, and cannot be accessed without taking the structure apart.

In the structure of the kind specified, it is known to use alternatives of the dip brazing, e.g. crimping that does not form metallurgical bond. These procedures usually result in obtaining non-compact and bulky structures.

Accordingly, there is a need in the art and it would be useful to have an inaccessible RF microwave structure and a method of fabricating this inaccessible RF microwave structure that employs the dip brazing technique to connect components of the waveguide structure. It would be advantageous to have such a method in which dummy load elements could withstand high temperature treatment of dip brazing. It would be also desired that the dummy load elements could match the network by giving a low voltage standing wave ratio (VSWR) and absorb the undesired RF energy.

According to one general aspect of the present invention, there is provided a method for fabricating an inaccessible RF microwave waveguide structure. The method includes providing various components from which the inaccessible RF microwave waveguide structure is composed.

According to another general aspect of the present invention, there is provided to an inaccessible RF microwave waveguide structure fabricated by the method of the present invention.

According to one embodiment of the present invention, the fabrication method includes providing one or more RF microwave waveguide networks, and one or more dummy load elements. The dummy load elements include a power absorbing body made of a ceramic material having high-temperature stable properties. The network includes an array of waveguide components having at least one aperture formed in the walls of the waveguides. Further, the dummy load elements are mounted in a predetermined place on the wall in the vicinity of the aperture. As can be appreciated, the method of the present invention can be used for fabrication of single layered and multilayered RF microwave waveguide structures.

When more than one waveguide network is used, the method includes the step of mounting the RF microwave waveguide networks one on top of the other to form a multilayered structure. The method also includes providing a blocking assembly configured for at least partially covering the RF microwave waveguide network.

According to one embodiment, the blocking assembly comprises a front cover and a back block which are respectively the front and back surfaces of the network with the dummy load element(s) mounted therein. In order to seal the RF microwave waveguide networks stacked together, the front cover and the back block are connected to the stacked networks by using the dip brazing technique.

According to one embodiment of the present invention, the dummy load includes a silicon carbide ceramic.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
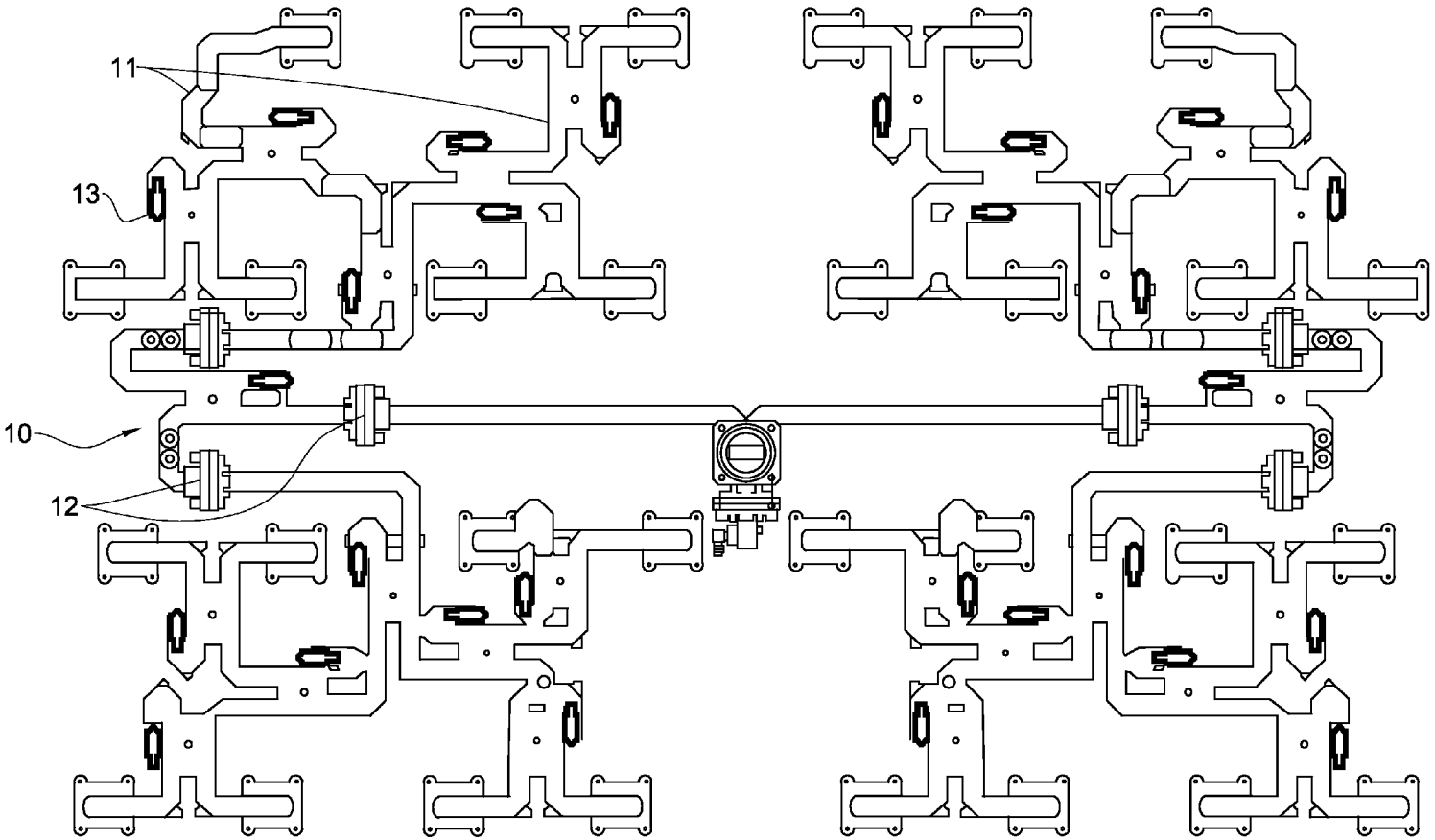
FIG. 1 is an example of a typical RF microwave waveguide network.
Figure 2:
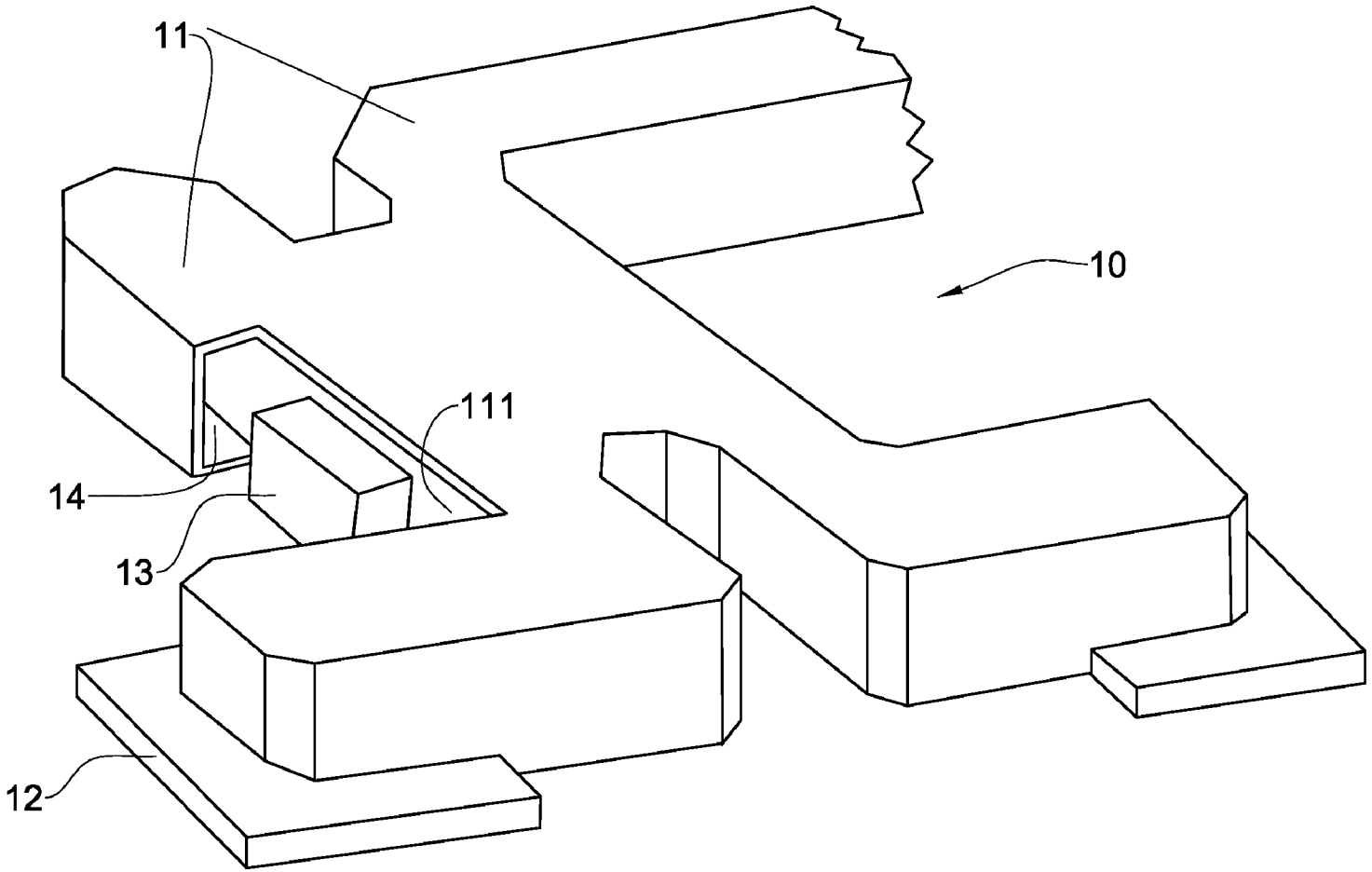
FIG. 2 is a partial magnified view of the RF microwave waveguide network to shown in FIG. 1.

The principles of the method according to the present invention may be better understood with reference to the drawings and the accompanying description, wherein like reference numerals have been used throughout to designate identical elements. It should be understood that these drawings, which are not necessarily to scale, are given for illustrative purposes only, and are not intended to limit the scope of the invention. Examples of constructions and fabrication processes are provided for selected elements. Those versed in the art should appreciate that many of the examples provided have suitable alternatives which may be utilized.

Figure 3:
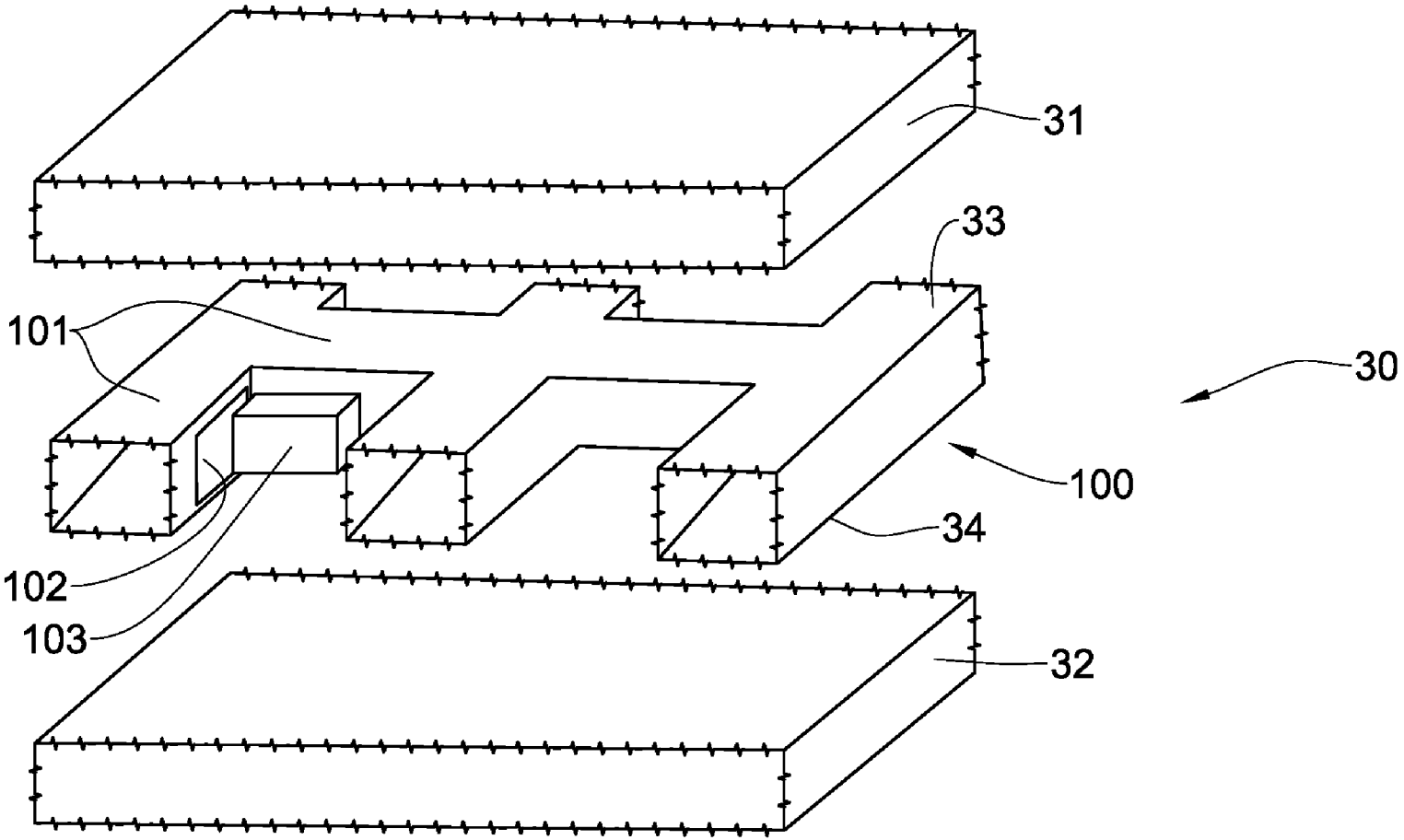
FIG. 3 is an exploded partial view of an inaccessible RF microwave waveguide structure, in accordance with one embodiment of the present invention.

Referring to FIG. 3, an exploded partial view of an inaccessible RF microwave waveguide structure 30 is illustrated, according to one embodiment of the present invention. The inaccessible RF microwave waveguide structure 30 comprises a RF microwave waveguide network 100 including an array of tortuous waveguide components 101, a high temperature stable dummy load 103, and a blocking assembly at least partially covering the network 100. In the present not limiting example, the blocking assembly is formed by a front cover 31 and a back block 32. The dummy load 103 is mounted on a surface of the wall of the waveguide components 101 at a required place in the vicinity of an aperture 102 arranged in the wall.

According to this embodiment, the front cover 31 and the back block 32 are each formed by one or more units and are connected to a front side 33 and a back side 34 of the RF microwave waveguide network 100, respectively. Also, in the present example, the units of the front cover 31 and the back block 32 are plates designed for a planar array antenna, and may be made of aluminum.

According to some embodiments of the present invention, the high temperature to stable dummy load 103 includes a power absorbing body which is made of thermo-stable ceramics. An example of the thermo-stable ceramics suitable for the dummy load 103 includes, but is not limited to, silicon carbide.

Figure 4:
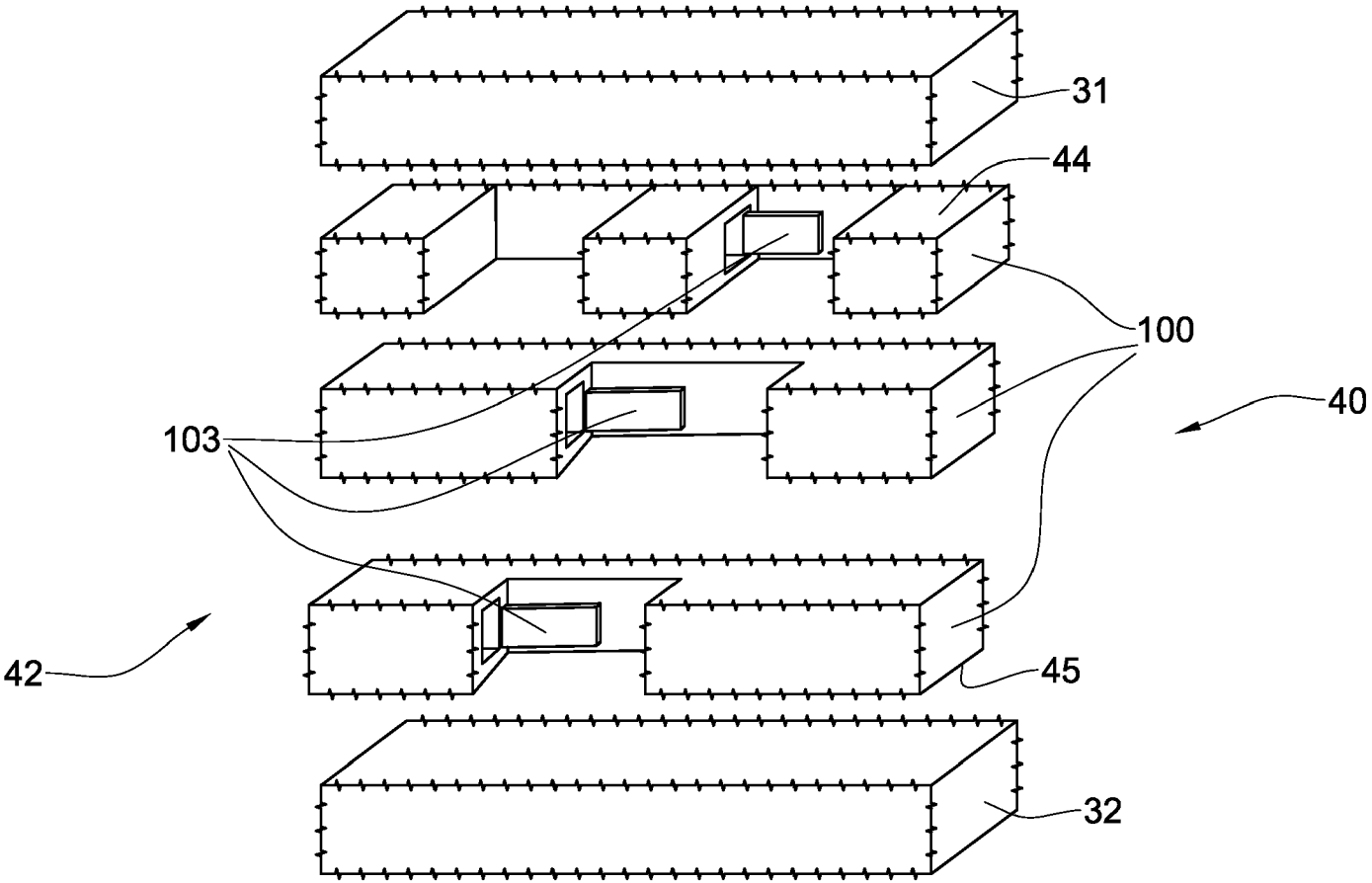
FIG. 4 is an exploded partial view of an inaccessible RF microwave waveguide structure, in accordance with an another embodiment of the present invention.

Referring to FIG. 4, an exploded partial view of an inaccessible RF microwave waveguide structure 40 is illustrated, according to another embodiment of the present invention. To facilitate understanding, the same reference numbers are used for identifying components that are common in all the examples of the invention.

The inaccessible waveguide structure 40 includes a plurality of the RF microwave waveguide networks 100, one or more high temperature stable dummy loads 103, and a blocking assembly that in the present example is also formed by the front cover 31 and the back block 32. As shown in FIG. 4, these RF microwave waveguide networks are mounted one on top of the other, thereby forming a multilayered arrangement 42. According to this embodiment, the front cover 31 and the back block 32 are plates attached to a front side 44 and a back side 45 of the multi-layered arrangement 42, respectively. This provision blocks the waveguide structure 40 from front and back sides.

As indicated above, the waveguide structures 30 and 40 may include a blocking assembly which at least partially covers the waveguide network, and namely covers at least those places of the network where the dummy loads are mounted. Such a blocking assembly may not necessarily be formed by the front cover 31 and the back block 32, and does not necessarily include a plate-like cover and block. For instance, the waveguide structures 30 and 40 may be part of an electronic device and be blocked by certain components of this electronic device. In this case, these components can serve the purpose of the blocking assembly (e.g., the front cover 31 and/or the back block 32).

Figure 5:
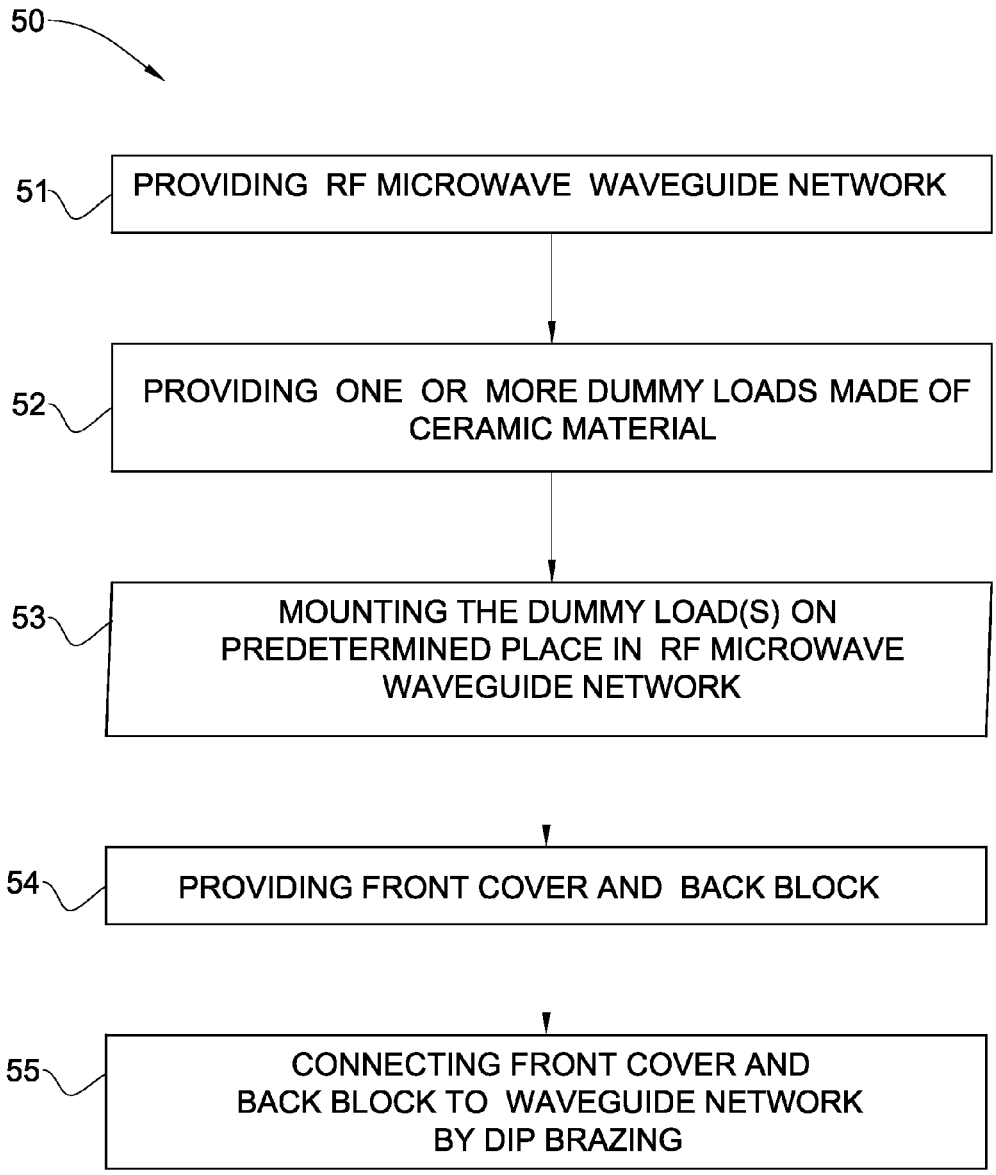
FIG. 5 is a block diagram of a fabricating method of an inaccessible RF microwave waveguide structure, according to one embodiment of the present invention.

FIG. 5 illustrates a flow chart of a method 50 of fabrication of the inaccessible RF microwave waveguide structure shown in FIG. 3, according to one embodiment of the present invention. The method includes providing an RF microwave waveguide network 100 (step 51), and providing one or more ceramic-based dummy loads 103 (step 52). Further, the dummy loads 103 are mounted in desired place(s) on the waveguide components 101 of the waveguide network 100 (step 53). The front cover 31 and the back block 32 (the blocking assembly in the present example) are provided, and then are attached to front and back sides of the waveguide network 100, respectively (step 54). Further, the front cover 31 and the back block 32 are dip brazed to the to waveguide network 100 (step 55).

It should be understood that the method of the present invention can also be employed for fabrication of the multilayered RF microwave waveguide network (40 in FIG. 4). The fabricating method of this structure mainly repeats the steps of the fabrication of the waveguide network shown in FIG. 3. However, it differs from the method shown in FIG. 5 in providing the plurality of the RF microwave waveguide networks (100 in FIG. 4) forming a multilayered arrangement 42 (rather than the single RF microwave waveguide network 100), and then connecting at least a part of components of the multilayered arrangement and covering them by the dip brazing technique to block from the adjacent components or any other surroundings.

The inaccessible RF microwave waveguide structures of the present invention may be suitable, for example, in planar array antennas.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

In the method claims that follow, alphabetic characters used to designate claim steps are provided for convenience only and do not imply any particular order of performing the steps.

Also, it is to be understood that the phraseology and terminology employed herein are for the purpose of description and should not be regarded as limiting.

Finally, it should be noted that the word "comprising" as used throughout the appended claims is to be interpreted to mean "including but not limited to".

It is important, therefore, that the scope of the invention is not construed as being limited by the illustrative embodiments set forth herein. Other variations are possible within the scope of the present invention as defined in the appended claims.

The invention claimed is:

1. An inaccessible RF microwave waveguide structure comprising an arrangement of at least one RF microwave waveguide network sealed by a dip brazed blocking assembly at least partially blocking said arrangement from surroundings, the RF microwave waveguide network comprising an array of waveguide components, at least one aperture in a wall of at least one waveguide component, and at least one dummy load element made of a ceramic material having high-temperature stable properties mounted in a predetermined place on said wall in the vicinity of the aperture.

2. A method for fabrication of an inaccessible RF microwave waveguide structure, comprising:

(a) providing an RF microwave waveguide network including an array of waveguide components, having at least one aperture in a wall of at least one waveguide component;

(b) providing at least one dummy load element made of a ceramic material having high-temperature stable properties;

(c) mounting at least one dummy load element in a predetermined place on said to wall in the vicinity of the aperture;

(d) providing a blocking assembly configured for at least partially covering RF microwave waveguide network; and (e) connecting said blocking assembly to said RF microwave waveguide network by using dip brazing, thereby blocking said at least part of the RF microwave waveguide network.

3. The method of claim 2, wherein said dummy load includes a silicon carbide ceramic.

4. The method of claim 2, wherein said blocking assembly comprises a front cover and a back block to be applied to respectively front and back surfaces of the network with said at least one dummy load element mounted therein.

5. The method of claim 2, wherein said inaccessible RF microwave waveguide network is a component of a planar array antenna.

6. An inaccessible RF microwave waveguide structure obtainable by the method of claim 2.

7. A method for fabrication of an inaccessible RF microwave waveguide structure, comprising:

(a) providing a plurality of RF microwave waveguide networks, at least one network including an array of waveguide components having at least one aperture in walls of the waveguides;

(b) providing at least one dummy load element made of a ceramic material having high-temperature stable properties;

(c) mounting said at least one dummy load element in a predetermined place on the wall in the vicinity of the aperture;

(d) mounting said plurality of the RF microwave waveguide networks one on top of the other to form a multilayered structure;

(e) providing a blocking assembly configured for at least partially covering said multilayered structure; and (f) connecting said blocking assembly to said multilayered structure by using to dip brazing; thereby blocking said at least part of multilayered structure of the RF microwave waveguide networks.

8. The method of claim 7, wherein said dummy load includes a silicon carbide ceramic.

9. The method of claim 7, wherein said blocking assembly comprises a front cover and a back block to be applied to respectively front and back surfaces of the multilayered structure.

10. The method of claim 7, wherein said inaccessible RF microwave waveguide structure is a component of a planar array antenna.

11. An inaccessible RF microwave waveguide structure obtainable by the method of claim 7.

* * * * *